US008080201B2

(12) United States Patent
Sawada et al.

(10) Patent No.: US 8,080,201 B2
(45) Date of Patent: Dec. 20, 2011

(54) METHOD FOR PRODUCING SPUTTERING TARGET MATERIAL FOR NI-W BASED INTERLAYER

(75) Inventors: Toshiyuki Sawada, Himeji (JP); Akihiko Yanagitani, Himeji (JP)

(73) Assignee: Sanyo Special Steel Co., Ltd., Himeji-Shi, Hyogo-Ken (JP)

( * ) Notice: Subject to any disclaimer, the term of this patent is extended or adjusted under 35 U.S.C. 154(b) by 266 days.

(21) Appl. No.: 12/173,337

(22) Filed: Jul. 15, 2008

(65) Prior Publication Data

US 2009/0022614 A1 Jan. 22, 2009

(30) Foreign Application Priority Data

Jul. 18, 2007 (JP) ..... 2007-186421

(51) Int. Cl.
*B22F 3/15* (2006.01)

(52) U.S. Cl. ..... 419/49

(58) Field of Classification Search ..... 419/49
See application file for complete search history.

(56) References Cited

U.S. PATENT DOCUMENTS

| | | | | |
|---|---|---|---|---|
| 6,174,598 | B1 * | 1/2001 | Suzuki et al. | 428/332 |
| 7,560,066 | B2 * | 7/2009 | Zhou et al. | 419/43 |
| 7,605,481 | B2 * | 10/2009 | Yamakoshi et al. | 257/779 |
| 2003/0031928 | A1 * | 2/2003 | Beteille et al. | 429/223 |
| 2003/0152755 | A1 * | 8/2003 | Suzuki | 428/209 |
| 2006/0099126 | A1 * | 5/2006 | Hosono et al. | 423/263 |
| 2008/0274371 | A1 * | 11/2008 | Thieme et al. | 428/655 |

FOREIGN PATENT DOCUMENTS

| | | |
|---|---|---|
| JP | 6248378 | 9/1994 |

* cited by examiner

*Primary Examiner* — Roy King
*Assistant Examiner* — Ngoclan Mai
(74) *Attorney, Agent, or Firm* — The Webb Law Firm

(57) ABSTRACT

There is provided a method for producing sputtering target materials which are used for a Ni—W based interlayer in a perpendicular magnetic recording medium. In this producing method, a Ni—W based alloy powder is prepared as a raw material powder. The alloy powder comprises 5 to 20 at % of W and the balance Ni and unavoidable impurities and is produced by gas atomization. The raw material powder is consolidated at a temperature ranging from 900 to 1150° C. This producing method makes it possible to significantly restrain expansion of the powder-filled billet in the consolidation step, thus efficiently producing Ni—W based sputtering target materials with stable qualities.

2 Claims, No Drawings

METHOD FOR PRODUCING SPUTTERING TARGET MATERIAL FOR NI-W BASED INTERLAYER

CROSS-REFERENCE TO RELATED APPLICATION

The present application claims priority to Japanese Patent Application No. 2007-186421 filed on Jul. 18, 2007, the entire disclosure of which is incorporated herein by reference.

BACKGROUND OF THE INVENTION

1. Field of the Invention

The present invention relates to a method for producing sputtering target materials which are used for a Ni—W based interlayer in a perpendicular magnetic recording medium.

2. Description of Related Art

In recent years, there have been remarkable progresses in magnetic recording technology, and heightening record densities in magnetic record media is proceeding due to increasing drive capacities. In magnetic record media for longitudinal magnetic recording systems currently used worldwide, however, attempts to realize high record densities result in refined record bits, which require high coercivity to such an extent that recording cannot be conducted with the record bits. In view of this, a perpendicular magnetic recording system is being studied as a means for solving these problems and improving record density.

The perpendicular magnetic recording system is a system in which a magnetization-easy axis is oriented in the direction vertical to a medium surface in the magnetic film of a perpendicular magnetic record medium, and is suitable for high record densities. For perpendicular magnetic recording, a multi-layer recording medium having a soft magnetic layer, an interlayer and a magnetic recording layer with increased recording sensitivity has been developed. A CoCrPt—$SiO_2$ based alloy is generally used for the magnetic recording layer, and a Co—Zr—Nb based alloy or the like is used for the soft magnetic layer. The interlayer described herein is a nonmagnetic layer which is typically provided for the purpose of having fine grain size structure of the crystal grains in the magnetic recording layer and imparting anisotropy to the crystal orientation.

The use of various alloys, such as Ni based alloys, Ta based alloys and Pd based alloys, is proposed for the interlayer. In particular, Ni—W based alloys have been studied in recent years. A casting process is primarily employed to produce Ni—W based alloys. It is said in general that because a sputtering target material produced by powder metallurgy has a very fine microstructure, the thin film deposited by sputtering is excellent in uniformity and low in failure percentage. There is, however, no publicly-known document in regard to the use of powder metallurgy in the process for producing the Ni—W based alloy target. In particular, in cases other than the sputtering target material, there has been known no example where an alloy powder containing 5 at % W or higher is consolidated.

In relation to the Ni-based alloy, there is proposed a technique for consolidating an alloy powder containing a high proportion of Cr and Mo effective in solid-solution strengthening as W. For example, as disclosed in Japanese Patent Laid-Open Publication No. H6-248378, it is proposed that a super-anticorrosion Ni-based alloy is produced by filling a workable capsule with a super-anticorrosion Ni-based alloy atomized powder and consolidating a filled body thus obtained in a consolidation step. The super-anticorrosion Ni-based alloy atomized powder comprises 0.03 wt % or less of C, 0.1 wt % or less of Si, 1.00 wt % or less of Mn, 19 to 24 wt % of Cr, 15 to 21 wt % of Mo, 1 to 5 wt % of W, 0.01 to 0.5 wt % of V, 1 to 5 wt % of Fe, 0.01 to 0.5 wt % of Al, 0.02 to 0.1 wt % of N, both or either of 0.5 wt % or less of Ti and 0.5 wt % or less of Nb, and the balance Ni and unavoidable impurities, and has a chemical composition range of 35 wt %≦Cr+Mo≦45 wt %.

SUMMARY OF THE INVENTION

This method as described in Japanese Patent Laid-Open Publication No. H6-248378, however, frequently gives rise to a problem that a portion filled with the powder is expanded when a billet degassed and charged with a Ni—W alloy powder is heated to a predetermined consolidation temperature ranging from 1100 to 1250° C. Sputtering target materials made from such an expanded billet have remaining pores, which make it difficult to produce a stable sputtering target material. Factors responsible for this are unknown in detail, but it is considered that an alloy containing 1 to 5 wt % of W as described in Japanese Patent Laid-Open Publication No. H6-248378 is different in behavior when heating from an alloy with a high W content, such as an alloy containing more than 5 at % of W as in the present invention.

In a method generally employed for eliminating the remaining pores, the consolidation is performed at a higher temperature to promote softening and sintering of the raw material powder. In contrast, a significant feature of the present invention is consolidation performed at a lower temperature to reduce the expansion of the billet and the remaining pores. Specifically, the billet expansion is significantly inhibited by setting the consolidation temperature at 1150° C. or less, and more advantageous effects can be beneficially exhibited by setting it at 1050° C. or less.

Thus, the inventors have now found that setting the consolidation temperature at 900 to 1150° C. can significantly restrain expansion of the powder-filled billet in the consolidation step, enabling efficient production of Ni—W based sputtering target materials with stable qualities.

Accordingly, it is an object of the present invention to significantly restrain expansion of the powder-filled billet in the consolidation step so as to efficiently produce Ni—W based sputtering target materials with stable qualities.

According to the present invention, there is provided a method for producing a sputtering target material for a Ni—W based interlayer, comprising the steps of:

preparing a Ni—W based alloy powder as a raw material powder, the alloy powder comprising 5 to 20 at % of W and the balance Ni and unavoidable impurities and being produced by gas atomization; and consolidating the raw material powder at a temperature ranging from 900 to 1150° C.

DETAILED DESCRIPTION OF THE INVENTION

The present invention will be described in detail below.

In the method for producing a sputtering target material for a Ni—W interlayer according to the present invention, a Ni—W alloy powder produced by gas atomization is used as a raw material powder. The raw material powder comprises 5 to 20 at % of W and the balance Ni and unavoidable impurities This is because recording characteristics are inferior when using a target material containing less than 5 at % of W is used for an interlayer of a hard disk and because recording characteristics as an interlayer of a hard disk deteriorate when using a target material containing more than 20 at % of W. A preferable range of the W content is 6 to 15 at %.

The raw material powder is consolidated at a temperature ranging from 900 to 1150° C. The setting of the consolidation temperature within 900 to 1150° C. makes it possible to significantly restrain expansion of a billet filled with a Ni—W based alloy powder. When the consolidation temperature is less than 900° C., the Ni—W based alloy powder cannot be adequately softened, resulting in a low relative density after being consolidated. On the other hand, when the consolidation temperature exceeds 1150° C., the probability of the expansion of the powder-filled billet is considerably increased. Accordingly, the consolidation temperature is set in a range of from 900 to 1150° C., preferably from 900 to 1100° C., and more preferably from 900 to 1050° C.

Through this consolidation step, a sputtering target material for a Ni—W based interlayer, which comprises 5 to 20 at % of W and the balance Ni and unavoidable impurities, can be efficiently produced with stable qualities.

EXAMPLES

The present invention will be described below in detail with reference to examples.

Raw-materials having W—Ni compositions shown in Table 1 were prepared. 25 kg of the base metal was inductively melted in an alumina crucible under argon, and then were tapped at 1700° C. through a 5-mm diameter tapping nozzle provided in a bottom portion of the crucible, followed by an Ar gas atomization at an atomizing pressure of 0.7 MPa to form a powder. The Ni—W alloy powder thus produced was filled into an SC can with an outer diameter of 205 mm, an inner diameter of 190 mm and a length of 300 mm, with the can being degassed. The ultimate vacuum pressure at the time of degassing was set at about $1.3\times10^{-2}$ Pa (about $1\times10^{-4}$ Torr). Then, in the case of using HIP (Hot Isostatic Pressing), the powder-filled billet was hot-isostatic pressed at a temperature of from 850° C. to 1250° C. under a pressure of 147 MPa. In the case of using the upsetting technique, the powder-filled billet was heated to a temperature of 850 to 1250° C., and then inserted into the container with inner diameter of 215-mm, followed by consolidation under a pressure of 500 MPa.

TABLE 1

| No. | Alloy Composition (at %) W | Ni | Consolidating Technique | Consolidating Temperature (° C.) | Ratio of Billet Expansion (Number of Expansions/ Number of Tests) | Relative Density (%) | Notes |
|---|---|---|---|---|---|---|---|
| 1 | 5 | Balance | HIP | 1050 | 0/3 | 99.5 | Inv. |
| 2 | 10 | Balance | HIP | 1050 | 0/8 | 99.1 | Ex. |
| 3 | 15 | Balance | HIP | 1050 | 0/7 | 98.9 | |
| 4 | 20 | Balance | HIP | 1050 | 0/2 | 98.6 | |
| 5 | 5 | Balance | HIP | 900 | 0/1 | 98.8 | |
| 6 | 5 | Balance | HIP | 950 | 0/1 | 99.1 | |
| 7 | 5 | Balance | HIP | 1000 | 0/11 | 99.9 | |
| 8 | 10 | Balance | HIP | 1100 | 1/9 | 99.7 | |
| 9 | 15 | Balance | HIP | 1150 | 3/15 | 98.6 | |
| 10 | 5 | Balance | Upset | 900 | 0/2 | 99.1 | |
| 11 | 10 | Balance | Upset | 1000 | 0/6 | 99.5 | |
| 12 | 15 | Balance | Upset | 1100 | 1/10 | 99.5 | |
| 13 | 20 | Balance | Upset | 1150 | 2/13 | 98.8 | |
| 14 | 5 | Balance | HIP | 850 | 0/1 | 96.1 | Comp. |
| 15 | 15 | Balance | HIP | 1200 | 3/4 | 97.7 | Ex. |
| 16 | 20 | Balance | HIP | 1250 | 1/1 | 97.3 | |
| 17 | 5 | Balance | Upset | 850 | 0/1 | 96.8 | |
| 18 | 15 | Balance | Upset | 1200 | 1/1 | 97.4 | |
| 19 | 15 | Balance | Upset | 1250 | 1/1 | 97.0 | |

Note:
Underlined part is outside of the conditions of the present invention
Inv. Ex.: Examples of the present invention, Comp. Ex: Comparative Examples For billet expansion evaluations shown in Table 1, the HIP consolidated material was evaluated by observing the external appearance of the billet after the HIP process. The upset material was evaluated by observing the external appearance of the billet at the time when the heated billet is removed from the furnace. The relative density in Table 1 shows the results as measured by the Archimedes method.

As shown Table 1, Nos. 1 to 13 are examples of the present invention, while Nos. 14 to 19 are comparative examples. Comparative Examples 14 and 17 have low relative densities because of the low consolidating temperatures. Comparative Examples 15, 16, 18 and 19 have high probability of billet expansion of 75% (¾) or higher. In contrast, it is seen that the consolidating temperature in each of Examples 1 to 13 satisfies the conditions of the present invention, advantageously restraining billet expansion in the consolidating step.

As described above, it is possible to produce a stable, highly dense Ni—W target material without expansion of a billet by performing the consolidation of Ni—W powder at 900 to 1150° C. in the process of producing a sputtering target material for a Ni—W interlayer which is used as an interlayer of a perpendicular magnetic recording medium.

What is claimed is:

1. A method for producing a sputtering target material for a Ni—W based interlayer, comprising the steps of:

preparing a Ni—W based alloy powder as a raw material powder, the alloy powder consisting of 5 to 20 at % of W and the balance Ni and unavoidable impurities and being produced by gas atomization;

filling a can with the raw material powder, with the can being degassed; and consolidating the raw material powder in the can at a temperature ranging from 900 to 1150 ° C. by HIP (Hot Isostatic Pressing) or upset technique to provide a sputtering target material for a Ni—W based interlayer.

2. The method according to claim 1, wherein the temperature in the consolidation step ranges from 900 to 1050° C.

* * * * *